US005487856A

United States Patent [19]

Saraf

[11] Patent Number: 5,487,856

[45] Date of Patent: Jan. 30, 1996

[54] PROCESS FOR THE MANUFACTURE OF A POST-HEAT SET DYED FABRIC OF POLYAMIDE FIBERS HAVING IMPROVED DYE WASHFASTNESS AND HEAT STABILITY

[75] Inventor: Anil W. Saraf, Asheville, N.C.

[73] Assignee: BASF Corporation, Parsippany, N.J.

[21] Appl. No.: 321,472

[22] Filed: Oct. 11, 1994

Related U.S. Application Data

[63] Continuation of Ser. No. 107,392, Aug. 16, 1993, abandoned.

[51] Int. Cl.[6] ..... D01F 1/10; D01F 6/60

[52] U.S. Cl. ..... 264/78; 8/494; 8/497; 8/924; 8/925; 264/103; 264/168; 264/210.6; 264/210.8; 264/211; 264/211.15

[58] Field of Search ..... 264/78, 103, 168, 264/210.6, 210.8, 211, 211.12, 211.14, 211.15, 129, 130; 8/494, 497, 924, 925

[56] References Cited

U.S. PATENT DOCUMENTS

| | | | |
|---|---|---|---|
| 2,855,267 | 10/1958 | Zimmerman . | |
| 3,086,960 | 4/1963 | Bletso . | |
| 3,437,641 | 4/1969 | Lenz et al. . | |
| 3,584,047 | 6/1071 | Dexter et al. | 564/153 |
| 3,652,199 | 3/1972 | Leung | 8/925 |
| 3,669,611 | 6/1972 | Shimauchi et al. . | |
| 3,677,965 | 7/1972 | Dexter et al. | 252/403 |
| 3,756,773 | 9/1973 | Isharani . | |
| 3,760,578 | 9/1973 | Kibler . | |
| 4,187,212 | 2/1980 | Zinke et al. | 524/101 |
| 4,308,025 | 12/1981 | Hussamy . | |
| 4,360,617 | 11/1982 | Muller et al. . | |
| 4,475,918 | 10/1984 | Kissling et al. | 8/495 |
| 4,598,113 | 7/1986 | Stephen et al. . | |
| 4,616,053 | 10/1986 | Schultz et al. . | |
| 4,832,699 | 5/1989 | Choi et al. . | |
| 4,859,389 | 8/1989 | Kurita et al. | 264/130 |
| 4,863,664 | 9/1989 | Burton . | |
| 5,236,652 | 8/1993 | Kidder | 264/211 |

FOREIGN PATENT DOCUMENTS

| | | |
|---|---|---|
| 201189 | 11/1986 | European Pat. Off. . |
| 3330120 | 3/1984 | Germany . |
| 4131926 | 4/1992 | Germany . |
| 55-71884 | 5/1980 | Japan . |
| 56-53293 | 5/1981 | Japan . |
| 992795 | 5/1965 | United Kingdom . |
| 1034877 | 7/1966 | United Kingdom . |
| 2248451 | 4/1992 | United Kingdom . |

*Primary Examiner*—Leo B. Tentoni
*Attorney, Agent, or Firm*—Nixon & Vanderhye

[57] ABSTRACT

Described is a process for the manufacture of polyamide fibers having improved dye washfastness and heat stability by melt mixing a fiber forming polyamide with an additive such as water, an alcohol, an amine and a heat stabilizer such as a phenolic compound or a phosphite containing aryl groups or a mixture thereof to form a homogeneous mixture, melt spinning polyamide fibers, quenching, drawing and taking up the polyamide fibers.

19 Claims, No Drawings

PROCESS FOR THE MANUFACTURE OF A POST-HEAT SET DYED FABRIC OF POLYAMIDE FIBERS HAVING IMPROVED DYE WASHFASTNESS AND HEAT STABILITY

This is a continuation of application Ser. No. 08/107,392, filed Aug. 16, 1993, now abandoned.

FIELD OF THE INVENTION

The present invention is directed to a process for the manufacture of nylon fibers with improved dye washfastness and heat stability by melt mixing a polyamide with an additive and a heat stabilizer.

BACKGROUND OF THE INVENTION

Anionic acid dyeing of polyamide yarns involves the reaction of the amino end group of the nylon yarn with the sulfonic acid end group of the dye molecules.

Depending on their chemical structure, the anionic dyes could possess a mono-, or a di-, or a tri-sulfonic acid end group. The reactivity of the dye with the fiber is directly proportional to the number of functional groups present in the dye and/or the fiber. Therefore, it follows that the greater the number of dye molecules that bond with the amine endgroups of the fiber, the better the washfastness of the fiber.

Several applications involve treatment of heat to the fabric prior to dyeing. A typical example is the case of elastic fabrics which are knitted with elastomeric yarns, e.g. LYCRA™ (DuPont, Wilmington) which imparts stretch to the fabric. Heatsetting of the fabric prior to dyeing is essential to avoid curling of the fabric. Typical heat setting temperatures range between as low as 90° C. to very severe temperatures of 200° C. When heat setting is conducted at elevated temperatures such as above 140° C., in air, oxidative degradation of the amino end groups occurs destroying the functional groups present in the fiber. This depletion of amino end groups reduces the affinity of the dye molecules to the fiber. Such a fabric picks up less dye than a non-heatset fabric, has a worse washfastness and has a dull appearance. In more severe cases the preheatset-and-dyed fabrics also exhibit streaky appearance. Therefore, there exists a need to improve the resistance to thermal degradation of polyamide yarns so as to retain the brightness of the fabric, improve the washfastness of the fabric and improve the uniformity of the dyed fabric.

To increase dye pick up of a heat set fabric, dyeing methods are modified. This involves increasing the temperature of the dye bath in some cases and/or reducing the pH of the dye bath, in many cases. Although, the modified dyeing procedure increases the affinity of the dye into the fiber, it is a temporary phenomenon, since after dyeing, the fabric is washed thoroughly to remove the acidity in the fabric. The dye molecules that are thus entrapped in the fiber, are loosely bound due to lack of chemically reactive sites in the fiber. Such molecules are susceptible to diffuse out of the fabric during subsequent washings. The physical size of these entrapped dye molecules have a significant influence the diffusion of the dye out of the fiber and hence, also the dye washfastness of the fabric. Thus fabrics dyed with smaller dye molecules would exhibit worse washfastness than larger ones. In many cases, the smaller dye molecules are also those which possess a mono-sulfonic acid group, i.e. the least number of functional groups, and hence a lesser affinity to the fiber. Pre-heatset polyamide yarns dyed with such dyes exhibit the worst washfastness.

To alleviate this problem, several methods have been invented. Most of these techniques involve a chemical treatment after the dyeing process. DE-A 4,131,926 describes a process wherein the dyed substrates like nylon are treated with dispersions of sterically hindered cycloaliphatic amines, which improves light and washfastness.

DE-A 3,330,120 discloses an aftertreatment of polyamide textiles, dyed with anionic dyes, with a polybasic compound which was a reaction product of a polymine with a cyanamide derivative to improve the wetfastness and washfastness.

Yet another method is disclosed in JP 81 53, 293 wherein acid dyed polyamide fibers are treated with a color fixing agent. This color fixing agent is based on a condensation product of a polysulfone, a compound containing amino groups and sulfonic acid groups, and an aldehyde. The washfastness of polyamide fibers treated with this agent is improved.

Similarly, JP 80 71,884 describes a polymeric quaternary ammonium compound which when applied to the face of a printed polyamide fabric, improves the colorfastness of the fabric.

Although improvements are claimed in washfastness by chemical aftertreatment processes, considerable deficiencies still exist in several applications. These relate to the fundamental issue of reduced affinity of certain dyes with the fiber due to the depletion of amino end groups during preprocessing of the polyamide fabric. A more important issue is that of increased cost of processing the fabric. The chemical aftertreatment not only involves the cost of an additional processing step but also the cost of chemical waste disposal and effluent water treatment. With tighter environment protection regulations on the types of disposable effluents, the economics of aftertreatments could get to be restrictive.

Therefore, there exists a need for a process that would improve the washfastness of polyamide yarns without increasing or altering the chemicals that are used currently in the dyebath. Furthermore, there also exists a need to achieve a better exhaustion of the dyebath so as to reduce the dyes and chemicals being released as effluents in the waste water.

U.S. Pat. No. 4,863,664 discloses a high speed process of making polyamide filaments by melt mixing polyamide with some additives like water, alcohols or organic acids prior to spinning. Although, the process claims to improve yarn quality, processability and dye washfastness of the fabric, it does not address the issue of heat stability of the fibers made from such a process. The poor heat stability and the resulting streaky dyeing are significant disadvantages of this process.

It was the object of the present invention to reduce or eliminate the deficiencies existing in current processes in relation to washfastness and heat stability of the fabric and provide a new process for the manufacture of polyamide fibers, with improved dye washfastness and heat stability.

In addition, it was also the object of the present invention to introduce a process for the manufacture of polyamide yarns which would possess reduced yellowing and retain the whiteness of the fabric after heat treatment.

Another object was to provide a process for the manufacture of polyamide fibers for the production of dyed fabrics having improved uniformity after heatsetting.

Yet another object was to provide a process for the manufacture of polyamide fibers which achieve a greater exhaustion of the dye bath at an increased rate thereby reducing the release of effluents of waste dyes and chemicals in waste water.

A further object was to provide a process for the manufacture of polyamide fibers for the production of dyed fabrics having deeper dye shades.

Since swimwear is one of the potential applications for the yarns of the present invention where resistance to fading in a chlorinated water pool is a major requirement, it was another objective of the present invention to provide a process for the manufacture of polyamide fibers which would possess improved resistance to color fading in a chlorinated water pool.

SUMMARY OF THE INVENTION

The objects of the present invention were achieved with a process for the manufacture of polyamide fibers, which comprises:

(a) melt mixing a fiber forming polyamide with
  (i) an additive selected from the group consisting of water, alcohols, amines and mixtures thereof; and
  (ii) a heat stabilizer selected from the group consisting of phenolic compounds, phosphite containing aryl groups and mixtures thereof;
  to form a homogeneous mixture;

(b) spinning polyamide fibers from the homogenous mixture through a spinnerette to form a homogeneous mixture;

(c) quenching the polyamide fibers;

(d) applying a spin finish to the fibers; and (e) winding the polyamide fibers.

DETAILED DESCRIPTION OF THE PREFERRED EMBODIMENTS

The process of the present invention starts in step (a) with the melt mixing of a fiber forming polyamide with an additive (i) and a heat stabilizer (ii).

Polyamides are well known by the generic term "nylon" and are long chain synthetic polymers containing amide (—CO—NH—) linkages along the main polymer chain. Suitable fiber-forming or melt spinnable polyamides of interest for this invention include those which are obtained by the polymerization of a lactam or an amino acid, or those polymers formed by the condensation of a diamine and a dicarboxylic acid. Typical polyamides include nylon 6, nylon 6/6, nylon 6/9, nylon 6/10, nylon 6/12, nylon 6T, nylon 11, nylon 12 and copolymers therof or mixtures thereof. Polyamides can also be copolymers of nylon 6 or nylon 6/6 and a nylon salt obtained by reacting a dicarboxylic acid component such as terephthalic acid, isophthalic acid, adipic acid or sebacic acid with a diamine such as hexamethylene diamine, metha-xylene diamine, or 1,4-bisaminomethyl cyclohexane. Preferred are poly-epsilon-caprolactam (nylon 6) and polyhexamethylene adipic acid or sebacic acid with a diamine such as hexamethylene diamine, metha-xylene diamine, or 1,4-bisaminomethyl cyclohexane.

Preferred are poly- epsilon- caprolactam (nylon 6) and polyhexamethylene adipamide (nylon 6/6). Most preferred is nylon 6.

Suitable additives (i) are water, mono-and polyalcohols, mono and diamines and mixtures thereof. Suitable monoalkahols are $C_2$- to $C_{18}$- alkohols like ethanol, propanol, butanol, hexanol, decanol, undecanol, octadecanol; arylsubsituted alcohols like benzyl alcohol and benzoin.

Suitable polyalcohols are glycols like ethylene glycol, diethylene glycol, triethylene glycol, propylene glycol, dipropylene glycol, neopentylglycol glycerin, trimethylolethan, trimethylolpropan and pentaerythritol.

Suitable amines for the additive (i) are mono- and diamines, preferred are diamines like hexamethylene diamine, meta-xylene diamine and 1,4 bis-aminomethyl cylohexane.

The preferred additive (i) is triethylene glycol and hexamethylenediamine.

The additive (i) is used in an amount of from about 0.5 to about 5% by weight, preferably from about 1 to about 4% by weight, most preferred from about 1.5 to about 3% by weight, based on the total amount of the polyamide fiber.

Suitable heat stabilizers are phenolic compounds, phosphites containing aryl groups and mixtures thereof.

Suitable phenolic compounds are compounds which contain at least one phenolic group with two lower alkyl substitutents in the aromatic ring, at least one of which is in ortho position of the hydroxyl group. The lower alkyl groups are preferably branched groups such as t-butyl. Examples for alkyl substituted phenolic groups are 3 t-butyl-6-methyl-4-hydroxy phenyl and 3,5-dimethyl-4-hydroxyphenyl.

Examples for phenolic compounds are disclosed in U.S. Pat. No. 4,187,212, the disclosure thereof is herewith incorporated by reference. Preferred are phenolic compounds such as 2,2'-methylene-bis(6-tert.-butyl-4-methylphenol), 2,2'-methylene-bis(6-tert.-butyl-4-ethylphenol), 2,2-bis(3,5-di-tert.butyl-4-hydroxyphenyl)-propane, 1,3,5-tris-(3,5-di-tert.-butyl-4-hydroxphenyl-propionyl)-hexahydro-s-triazine, N,N'-di(3,5-di-tert.-butyl-4-hydroxyphenyl-propionyl)-hexamethylenediamine, 1,3,5-tri(3,5-di-tert.-butyl-4-hydroxybenzyl)-2,4,6-trimethylbenzene, pentaerythritol-tetra-[3-(3,5-di-tert.-butyl-4-hydroxy-phenyl)-propionate], β-(3,5-di-tert.-butyl-4-hydroxyphenyl)-propionic acid-n-octadecyl ester, thiodiethylene glycol-β[4-hydroxy-3,5-di-tert.-butyl-phenyl]propionate, 2,6-di-tert.-butyl-4-methylphenol, and 3.9-bis[1,1-dimethyl-2-(3,5-ditert.-butyl-4-hydroxy-phenyl)-ethyl]-2,4,8,10-tetraoxaspiro-[5,5]-undecane.

U.S. Pat. Nos. 3,584,047 and 3,677,965 disclose polyamides containing these alkyl substituted phenolic groups, more specifically polyamides derived from alkylhydroxyphenylalkanoic acids and polyamines. These compounds are particularly suitable for the present invention and the disclosures of these patents are herewith incorporated by reference.

Suitable phosphites containing aryl groups are disclosed for example in U.S. Pat. No. 4,187,212, the disclosure thereof is herewith incorporated by reference.

Preferred phosphites are:

tris-(2,5-ditert.-butylphenyl)-phosphite, tris-(2-tert.-butylphenyl)-phosphite, tris-(2-phenylphenyl)-phosphite, tris-(2-(1,1-dimethylpropyl)-phenyl)-phosphite, tris-[2,4-di-(1,1-dimethylpropyl)-phenyl]-phosphite, tris-(2-cyclohexylphenyl)-phoshite, and tris-(2,4-ditert.-butylphenyl)-phosphite.

Particularly useful are mixtures of phenolic compounds with phosphites.

The heat stabilizer is used in an amount of from about 0.025 to about 2% by weight, preferably from about 0.1 to about 1.5 by weight, most preferred from about 0.15 to about 1.25% by weight, based on the total weight of the polyamide fiber.

The melt mixing is performed in an extruder at a temperature of 20° to 40° C. above the melting temperature of the polyamide being used.

The additive (i) and the heat stabilizer (ii) may be added together or separately to the polymer chips or grannules before they enter the extruder, or may be added into the opening of the extruder together with the polyamide or may be added through a side extruder directly into the melt, where the mixing to a homogeneous mixture takes place.

In step (b) the homogeneous mixture of fiber forming polyamide, additive (i) and heat stabilizer (ii) are spun through a conventional spinnerette to form fibers, which are solidified by quenching them with air in step (c). In step (d), the fibers are treated with a finish such as a lubricating oil or a mixtue of oils and an antistatic agent. The application of finish provides an efficient runnability of the fiber on the spinning machine and in subsequent processing steps. The fibers can be spun in any one of the following ways:

1) a two step process at a speed from about 400 m/min to about 1500 m/min, preferably from about 600 m/min to about 1200 m/min and drawn in a second step or, 2) a one step spin-draw-wind process or 3) a one step high speed spinning process without drawing the yarn, at a speed of at least about 3000 m/min, preferably with at least about 3500 m/min.

An optional step is texturizing the fibers with, for example, and air jet, gear crimping, stuffer box, or edge crimping process. In several cases, drawing and texturizing could also be performed in a single step, such as in case of a one step bulked continuous filament (BCF) yarn process for carpet enduse. The textured yarn produced on such a process is taken up in step (e) to be wound on a package.

The fibers of the present invention have deniers (denier= weight in grams of a single filament with a length of 9000 meters) in the range of about 0.5 to 20.0 denier/filament (dpf). A preferred range is from about 0.7 to 3.0 dpf.

The fibers of the present invention have an amine end group (AEG) content of from about 15 to about 70 meg/kg, preferably from about 35 to about 50 meg/kg, and a relative viscosity (RV) of from about 2.0 to about 3.2, preferably from about 2.2 to 3.0.

The combined effect of the heat stabilizer (ii) and the increased AEG of the polymer resulting from the additive (i), results in an enhanced dyeability, improved washfastness, better heat stability. An additional advantage also results from the reduction in the starting concentration of dye bath to achieve shades similar to that of a control yarn. Alternatively, deeper shades which cannot be achieved with a control yarn are possible with this invention.

Other advantages become apparent from the following examples.

EXAMPLES

Nylon 6 (ULTRAMID® BS 700F, BASF Corporation, Freeport, Tex.) was extruded at a temperature of 272° C. through a 12 hole round cross section spinneret of hole diameter 200 microns and capillary length of 400 microns. Triethylene glycol (TEG) was injected at the throat of the extruder during spinning by means of a Zenith metering pump at different levels. The filaments were cooled in a quench cabinet where air at 55° F. and 65% relative humidity was blown at 100 ft/min. The filaments passed through a tangling jet and were taken up by a set of godets running at 5500 m/min. The yarn then went through a steam chamber where steam at a temperature of 130° C. was maintained at a pressure of 65 psi. The yarn was wound on a Barmag SW-6 winder at a speed of 5390 m/min.

Table I indicates the relative viscosity, the amine end group content (AEG) and the mechanical properties of the yarn obtained using different levels of triethylene glycol (TEG) addition.

TABLE I

| Exam. | % TEG | Rel. A Visc. | E (meq/kg) | G Denier | T e (gpd) | n Elo (%) | % BWS |
|---|---|---|---|---|---|---|---|
| 1 | 0 | 2.79 | 34.6 | 42.1 | 3.82 | 53.5 | 7.53 |
| 2 | 1 | 2.57 | 39.5 | 42.1 | 4.11 | 52.2 | 7.87 |
| 3 | 1.5 | 2.53 | 41.9 | 42.1 | 4.07 | 51.8 | 7.53 |
| 4 | 2 | 2.47 | 44.5 | 42.0 | 4.02 | 50.6 | 8.17 |
| 5 | 2.5 | 2.40 | 47.1 | 41.8 | 3.91 | 49.7 | 8.33 |
| 6 | 3 | 2.36 | 49.7 | 41.97 | 3.83 | 49.9 | 8.20 |

TABLE II

| Example | Density (g/cc) | % Alpha | % Gamma | % Crystallinity |
|---|---|---|---|---|
| 1 | 1.13672 | 52.0 | 48.0 | 30.5 |
| 2 | 1.13843 | 46.8 | 53.2 | 32.2 |
| 3 | 1.13951 | 38.8 | 61.2 | 33.6 |
| 4 | 1.13904 | 40.7 | 59.3 | 33.0 |
| 5 | 1.14134 | 39.9 | 60.1 | 35.0 |
| 6 | 1.13961 | 41.6 | 58.4 | 33.5 |

The morphological properties of the fibers are listed in Table II. The density of fibers was measured using a QUANTACHROME® Helium pycnometry. No correction was made for additive volumes. A typical high speed spun polyamide fiber exhibits two types of crystal structures, namely, alpha and gamma. The percent composition of each of the crystal types present can be obtained using Wide Angle X-ray Diffraction (WAXD) techniques. A theta-two theta equatorial WAXD scan of nylon 6 can be resolved into 5 peaks, 4 of which are assigned as crystalline peaks, namely, $\alpha_{200}$, $\gamma_{001}$, $\gamma_{200}$ and $\alpha_{002}$. The relative fractions of alpha and gamma crystals can be obtained from ratios of the integrated intensities of the resolved peaks. Equatorial $\theta$–$2\theta$ difractometer scans were obtained on a Siemens D500 x-ray generator with a Cu-K$\alpha$ radiation generated at 40 kV and 25 mA. The five-line model developed by Heuvel and Huismann (H. M. Heuvel and R. Huismann, *J. Appl. Polym. Sci., Polym. Phys. Ed.*, 19, 121 (1981)) was used to resolve peaks and obtain the $\alpha/\gamma$ ratios.

The crystallinity was calculated based on the fiber densities obtained from the He-pycnometer and the $\alpha$–$\gamma$ crystal ratios obtained from the X-ray scans, using the formula:

$$\%Xc = \frac{\rho - \rho_a}{\rho_c - \rho_a} 100$$

where, $X_c$ is the volume fraction crystallinity, $\rho$ is the density of fiber, $\rho_a$ is the density of amorphous phase (1.10 gm/cc) and, $\rho_c$ is the density of the pure crystalline phase, which is obtained from the following equation, $$\rho_c = \frac{(1.23*\%\alpha) + (1.21*\%\gamma)}{100}$$

Density of pure alpha phase is taken as 1.23 gm/cc and that of pure gamma phase is taken to be 1.21 gm/cc) ["Polymer Handbook," Ed. J. Brandup and E. H. Immergut, Publ. J. Wiley and Sons, N.Y. (1989)].

Mechanical properties of the fiber were measured using the Statimat tensile tester at a rate of extension of 24 cm/min and a gage length of 20 cm.

To determine the boiling water shrinkage lengths of skeins ($l_o$) of 90 m of yarn were measured at a pretension of 0.056 gm/den and were allowed to shrink freely in a boiling water bath for 1 min. The length of skeins (l) were remeasured at the same pretension and the percent shrinkage was calculated based on $dl/l_o$, where dl is the change in length of the sample, ($l_o$–l).

Relative viscosity of yarns were measured by a single point method. Flow times of solutions ($t_s$) of 1% by weight yarns in formic acid were measured using a Ubelhode viscometer and were compared to those of pure solvent ($t_o$). The relative viscosity (RV) was calculated as $t_s/t_o$. The RVs thus obtained were converted to those that would have been obtained using sulfuric acid as solvent using a calibration curve.

The amino end group (AEG) concentration was obtained by standard potentiometric titration method. A 3.33% solution of dry polymer or yarn was prepared in 68% phenol/32% methanol and titrated against 0.02 N hydrochloric acid to a predetermined pH. The AEG was calculated from a calibration curve obtained using polymer chips of known AEGs.

The yarns were knitted into fabrics and dyed using the following procedure. The greige fabrics were preheatset at 193° C. for 60 seconds. A dye bath with a liquor ratio of 15:1 was prepared which contained 1% owf Irgalev PBF, 2% owf Ammonium sulfate and 2% owf Acetic acid of a centration of 56%. Critical commercial swimwear shades were used to test these samples.

| Shade | Dye Formula |
|---|---|
| Red | 1.0% Intrazone Red G190% (Crompton & Knowles)<br>2.5% Erio Acid Red XB (Ciba Geigy) |
| Blue | 2.5% Erionyl Brilliant Blue RL 200% (Ciba Geigy)<br>1.0% Solophenyl Turquoise Blue GRL 250% (Ciba Geigy) |

Dyeing was carried out at 96° C. for one hour. After dyeing the samples were rinsed and treated in a bath of 1.0% acetic acid (28%), 3% tannic acid and 4.0% fixing agent XP-10 (Piedmont Chemical Industries, Inc.) for 30 minutes. These aftertreated samples were rinsed in a bath of 0.5% Peregal ST with a liquor ratio of 40:1 at 60° C. for 10 minutes. The rinsed samples were later dried and tested for washfastness.

Dye washfastness of the samples was measured by using a "cigar bleed" test, described as follows. 2"×4" samples of the dyed fabric were wrapped in a 2"×4" white nylon fabric in the shape of a cigar. The cigar roll kept in a wet bath at room temperature for 24 hours. The fabrics were dried and the level of staining obtained on the white fabric was graded on a scale of 1 through 5, 5 being the least stained. Table III shows the cigar bleed test results conducted in examples 1 through 6. No attempts were made to match the shade to the control.

TABLE III

| | Cigar Bleed Rating | |
|---|---|---|
| Example | Blue shade | Red shade |
| 1 | 2 | 2 |
| 2 | 2.5 | 2.5 |
| 3 | 3 | 3 |
| 4 | 4.5 | 3.5 |
| 5 | 4.5 | 3.5 |
| 6 | 4.5 | 3.5 |

The percent reflectance, (% R), an indicator of the amount of light reflected from samples dyed with blue shade was measured using a CS-5 CHROMA SENSOR® spectrophotometer made by Applied Colored Systems, Inc. The spectrophotometer was run in the specular-included measurement mode with an area of view of 0.236" and an angle of view of 10°; The ratio of the absorption coefficient to the scattering coefficient (K/S), an indicator of the degree of the depth of shade was calculated using the Kubleka-Munk approximation:

$$K/S = \frac{(1-R)^2}{2R}$$

Table IV depicts the results obtained from the spectrophotometer in examples 1–6. Tristimulus values and CIE L*a*b* coordinates were calculated from the reflectance data over the range of wavelengths (400 nm to 700 nm). ΔL*, a measure of a change in lightness of shade and ΔE*, a measure of an overall color difference in comparison to the control (example 1) were obtained using standard methods [F. W. Billmeyer, Jr. and M. Saltzman, "Principals of Color Technology," Pub. J. Wiley & Sons, N.Y. (1981)]

TABLE IV

| Example | % R | K/S | ΔL | ΔE |
|---|---|---|---|---|
| 1 | 6.22 | 7.0686 | — | — |
| 2 | 5.14 | 8.74 | −2.60 | 3.37 |
| 3 | 5.33 | 8.40 | −2.15 | 3.09 |
| 4 | 4.20 | 10.92 | −5.91 | 7.24 |
| 5 | 4.25 | 10.78 | −6.02 | 7.30 |
| 6 | 3.18 | 14.75 | −10.7 | 12.70 |

A negative ΔL* value indicates darker shade as compared to the control.

In a separate experiment, attempts were made to match several shades obtained on the control with those obtained using example 6. To achieve the same shade as the control sample, the amount of dyestuff in the dye bath containing example 6 had to be significantly reduced. Table V indicates the respective starting dyebath concentrations of the dyes after the shades were matched.

TABLE V

| Shade | Color | Example 1 | Example 6 | Difference |
|---|---|---|---|---|
| Red | Erio Acid Red 1) | 2.0% | 0.21% | −90% |
| | Intrazone Red 2) | 2.0% | 0.92% | −54% |
| Raspberry | Telon Fast Blue 3) | 0.31% | 0.17% | −46% |
| | Nylomine Red 2CB 4) | 1.91% | 0.87% | −54% |
| | Telon Ex Yellow 3) A-3GL | 0.013% | 0.0% | −100% |
| Green | Acidol Br. Yellow 5) 8GX-N | 0.75% | 0.39% | −48% |
| | Nylon Turquoise HGL 6) | 0.30% | 0.22% | −27% |
| | Nylanthrene Pink 2) BLRF | 0.02% | 0.022% | +10% |
| Sky Blue | Acidol Br. Blue 5) M-5G | 0.96% | 0.41% | −43% |
| | Erionyl Br. Blue 1) RL 200% | 0.43% | 0.25% | −42% |

1) Ciba Geigy
2) Crompton & Knowles
3) Mobay
4) ICI
5) BASF
6) Miles, Inc.

The cigar bleed test was performed on these color-matched samples. The results of the cigar bleed test as tabulated in Table VI clearly reveal the superior dye fastness of the sample containing TEG.

TABLE VI

| | Cigar bleed rating | |
|---|---|---|
| Shade | Example 1 | Example 6 |
| Red | 1 | 3.5 |
| Raspberry | 4 | 5 |
| Green | 4 | 5 |
| Sky Blue | 5 | 5 |

Examples 7 and 8 in Table VII are results of a separate experiment conducted under processing conditions similar to those in examples 1–6, however, the amount of additives and the polymer viscosities were different. To process example 8, a homogeneous slurry of TEG, Irganox® B-1171 and $TiO_2$ was prepared using a Waring blender in the ratio (76% TEG, 14% $TiO_2$ and 10% Irganox® B1171) and the mixture was injected at the throat of the extruder. The injection method was similar to the one used in examples 2–6. The rate of injection was adjusted so as to get 1.6% TEG, 0.25% IRGANOX® B 1171 and 0.3% $TiO_2$ in the yarn.

TABLE VII

| | | | | | | AEG after heat setting | |
|---|---|---|---|---|---|---|---|
| | | RV | | AEG | | | |
| Ex. | Chip | Chip | Yarn | Chip | Yarn | 380 F-1 min | 380 F-2 min |
| 7 | BS403F | 2.40 | 2.48 | 28 | 24 | 18 | 14 |
| 8 | BS700F+* | 2.70 | 2.65 | 37 | 42 | 36 | 33 |

(* = 1.6% TEG + 0.25% Irganox ® B 1171 + 0.3% $TiO_2$)

Examples 1 through 8 were knitted into fabrics and heat set at 380F. for 1 min and 2 mins. The degree of yellowing was measured on a spectrophotometer. Δb values indicate the degree of yellowing compared to that of the non-heatset fabrics. Higher Δb values indicate greater yellowing. Table VIII depicts the Δb values for examples 1 –8.

TABLE VIII

| | Δb | |
|---|---|---|
| Example | 380 F-1 min | 380 F-2 min |
| 1 | 6.03 | 9.83 |
| 2 | 7.41 | 10.2 |
| 3 | 10.89 | 11.64 |
| 4 | 7.09 | 9.53 |
| 5 | 8.10 | 11.19 |
| 6 | 8.50 | 11.66 |
| 7 | 7.7 | 12.8 |
| 8 | 5.5 | 6.6 |

During dyeing, small aliquots of dyebath liquor were sampled at regular intervals for concentration measurement on a precalibrated spectrophotometer. The rate of dye pick up was thus obtained using 1.5% of tectilon blue dye in the dyebath. Table IX indicates the amount of dye on the fabric expressed as a percentage.

TABLE IX

| Time (min) | Example 7 | Example 8 |
|---|---|---|
| 0 | 0 | 0 |
| 5 | 13% | 18% |
| 10 | 18% | 38% |
| 20 | 45% | 69% |
| 30 | 58% | 70% |
| 40 | 53% | 66% |
| 50 | 50% | 65% |
| 60 | 52% | 70% |

Clearly, example 8 exhibits a much higher rate of dyeing as well as a greater dye uptake.

In another experiment examples 7 and 8 were dyed to saturation and the residual equilibrium dyebath concentration was measured in each case. The amount of dye on the fabric was calculated after normalizing for weights of the samples in the baths.

The data in Table X confirms the higher amount of dye uptake for the sample containing TEG and IRGANOX® B1171.

TABLE X

| Example | DYE SATURATION VALUES % Dye OWF* |
|---|---|
| 7 | 2.2 |
| 8 | 5.2 |

*OWF = on weight of fabric

The colorfastness to water in a chlorinated pool test was conducted on examples 7 and 8 using the standard AATCC test method 162-1986 (AATTCC Technical Manual/1988, 295). The results were compared to the control and graded according to a gray scale of 1–5, 5 indicating least fading in the pool. Results in table XI clearly reveal an enhanced resistance to color fading to water in the chlorinated pool test.

TABLE XI

| | Test grade | |
|---|---|---|
| Example | Turquoise shade | Raspberry shade |
| 7 | 2–3 | 3 |
| 8 | 3 | 3–4 |

We claim:

1. A process for the manufacture of a post-heat set dyed fabric consisting essentially of polyamide fibers having improved dye washfastness and heat stability, which comprises:

(a) forming a homogeneous spinnable polyamide mixture by melt-mixing a fiber-forming polyamide having a relative viscosity of between about 2.0 to about 3.2 with (i) an amine end group-increasing additive selected from the group consisting of water, alcohols, amines and mixtures thereof, said additive being present in said mixture in an amount between about 0.05 to about 5% by weight, based on the total weight of the polyamide fiber, sufficient to increase the amine end group content of said polyamide fiber to between about 15 to about 70 meq/kg; and (ii) a heat stabilizer selected from the group consisting of phenolic compounds, phosphites containing aryl groups and mixtures thereof, said heat stabilizer being present in said polyamide fiber in an amount between about 0.025 to about 2% by weight, based on the total weight of the polyamide fiber, sufficient to improve heat stability of the polyamide fiber;

(b) melt-spinning the homogeneous mixture obtained according to step (a) through a spinnerette to form polyamide fibers;

(c) quenching the polyamide fibers;

(d) forming the quenched polyamide fibers into a fabric; and (e) subjecting the fabric formed according to step (d) to the sequential steps of heat-setting and dyeing, said polyamide fibers of said fabric, when dyed, having improved dye washfastness as determined by a cigar bleed test stain rating of at least 3.5 on color matched samples.

2. The process according to claim 1, further comprising a drawing step before step (d).

3. The process according to claim 1, further comprising a drawing step after step (d).

4. The process according to claim 2, further comprising a texturing step after drawing.

5. The process according to claim 2, wherein the draw ratio is from about 1.0 to about 4.0.

6. The process according to claim 3, wherein the draw ratio is from about 1.0 to about 3.0.

7. The process according to claim 1, wherein the fiber forming polyamide is selected from the group consisting of nylon 6, nylon 6/6, nylon 6/9, nylon 6/10, nylon 6/12, nylon 6T, nylon 11, nylon 12, copolymers thereof and mixtures thereof.

8. The process according to claim 7, wherein the polyamide is nylon 6 or nylon 6/6.

9. The process according to claim 8, wherein the polyamide is nylon 6.

10. The process according to claim 1, wherein the alcohols are selected from the group consisting of benzylalcohol, benzoin, ethylene glycol, diethylene glycol, triethylene glycol, propylene glycol, dipropylene glycol, neopentylglycol, glycerin, trimethylolethan, trimethylolpropan, pentaerythritol and mixtures thereof.

11. The process according to claim 1, wherein the alcohols are glycols.

12. The process according to claim 11, wherein the glycol is triethylene glycol.

13. The process according to claim 1, wherein the amine is a mono-or diamine.

14. The process according to claim 1, wherein the amine is selected from the group consisting of hexamethylene diamine, meta-xylene diamine, 1,4 bis-aminomethyl cyclohexane, and mixtures thereof.

15. The process according to claim 1, wherein the phenolic compound comprises at least one dialkyl hydroxyphenyl group, wherein at least one alkyl group is in ortho position to the hydroxyl group.

16. The process according to claim 1, wherein the phenolic compound is selected from the group consisting of 2,2'-methylene-bis(6-tert.- butyl-4-methylphenol), 2,2'-methylene-bis-(6 -tert.-butyl-4 -ethylphenol), 2,2-bis-(3,5-di-tert. butyl-4-hydroxyphenyl)-propane, 1,3,5-tris-(3,5-di-tert.-butyl-4-hydroxyphenyl-propionyl)-hexahydro-s-triazine, N,N'-di(3,5,-di-tert.-butyl-4-hydroxphenyl-propionyl)-hexamethylenediamine, 1,3,5-tri(-3,5-di-tert.-butyl-4-hydroxybenzyl)-2,4,6-trimethylbenzene, pentaerythritol-tetra[3-(3,5-di-tert.-butyl-4-hydroxyphenyl)-propionate], β(3,5-di-tert.-butyl-4-hydroxphenyl)-propionic acid-n-octadecyl ester, thiodiethylene glycol β-[4-hydroxy-3,5-di-tert.-butyl phenyl] propionate, 2,6 di-tert.-butyl-4-methyl-phenol, 3,9-bis-[1,1-dimethyl-2-(3,5-ditert.butyl-4-hydroxy-phenyl)-ethyl]- 2,4,8,10-tetraoxaspiro-[5,5]-undecane, polyamides derived from alkylhydroxyphenylalkanoic acids with polyamines and mixtures thereof.

17. The process according to claim 1, wherein the phosphite, containing aryl groups, is selected from the group consisting of tris-(2,5-ditert.-butylphenyl)-phosphite, tris-(2-tert.-butylphenyl)-phosphite, tris-(2-phenylphenyl)-phosphite, tris-[2-(1,1-dimethylpropyl)-phenyl]-phosphite tris-[2 4-di-(1,1-dimethylpropyl)-phenyl]-phosphite, tris-(2-cyclohexylphenyl)-phosphite, tris-(2-tert.-butyl-4-phenylphenyl)phosphite, and tris-(2,4-ditert.-butylphenyl)-phosphite.

18. The process according to claim 1, wherein the fibers are spun in step (b) with a speed of at least about 400 m/min.

19. The process of claim 1, wherein between steps (c) and (d) there are practiced the steps of applying a spin finish to the polyamide fibers, and winding the polyamide fibers.

* * * * *

UNITED STATES PATENT AND TRADEMARK OFFICE

CERTIFICATE OF CORRECTION

PATENT NO. : 5,487,856

DATED : January 30, 1996

INVENTOR(S) : Anil W. Saraf

It is certified that error appears in the above-indentified patent and that said Letters Patent is hereby corrected as shown below:

At column 11, line 37, please delete "0.05" and replace it with "0.5".

Signed and Sealed this

Eleventh Day of June, 1996

*Attest:*

Bruce Lehman

BRUCE LEHMAN

*Attesting Officer*

*Commissioner of Patents and Trademarks*